US005183329A

United States Patent [19]

Chen

[11] Patent Number: 5,183,329

[45] Date of Patent: Feb. 2, 1993

[54] ELECTRIC COUPLER FOR A LIGHTED INFLATABLE DEVICE

[76] Inventor: Henry Chen, 5F, No. 25, Lane 15, Hsingyun Street, Neihu, Taipei, Taiwan

[21] Appl. No.: 745,559

[22] Filed: Aug. 15, 1991

[51] Int. Cl.[5] ..... F21V 1/06; F21V 33/00

[52] U.S. Cl. ..... 362/352; 362/253; 362/806; 446/220; 446/485

[58] Field of Search ..... 362/96, 352, 253, 806; 446/220, 223, 224, 225, 226, 485

[56] References Cited

U.S. PATENT DOCUMENTS

| | | | |
|---|---|---|---|
| 1,530,923 | 3/1925 | Anns | 446/224 |
| 1,912,960 | 6/1933 | Aki et al. . | |
| 2,383,390 | 8/1945 | Jacobs | 446/220 |
| 2,748,256 | 5/1956 | Moran | 446/226 |
| 4,292,999 | 10/1981 | Szollmann | 446/220 |
| 4,586,456 | 5/1986 | Forward | 446/220 |
| 4,586,910 | 5/1986 | Buchanan | 446/220 |
| 4,776,589 | 10/1988 | Yang | 273/58 G |
| 4,778,431 | 10/1988 | Dudley | 446/223 |
| 4,997,403 | 3/1991 | Akman | 446/220 |
| 5,075,830 | 12/1991 | Perez | 362/352 |

*Primary Examiner*—Ira S. Lazarus
*Assistant Examiner*—Y. Quach
*Attorney, Agent, or Firm*—Bacon & Thomas

[57] ABSTRACT

An electric coupler for a lighted inflatable device comprising a base attached to a cloth of a lighted inflatable device at the inside through the process of heat sealing with a passage way defined therein for inserting a light string from the outside into the lighted inflatable device, and a sealing cap to block up the passage way is disclosed. The sealing cap has terminals for connecting an external power supply to the light string inserted inside the lighted inflatable device by connectors. The light string is separately packed during delivry, and inserted inside the lighted inflatable device when in use.

2 Claims, 5 Drawing Sheets

ELECTRIC COUPLER FOR A LIGHTED INFLATABLE DEVICE

BACKGROUND OF THE INVENTION

The present invention relates to electric circuit couplers and relates more particularly to an electric coupler for a lighted inflatable device, by means of which the light string for the lighted inflatable device can be separately packed during delivery.

In U.S. Pat. No. 4,776,589 there is disclosed a lighted inflatable device which has a light string fastened therein which when connected to an external power supply produces a variable lighting effect. The light string is fixedly fastened inside the lighted inflatable device during the manufacturing process of the lighted inflatable device, and therefore, the manufacturing procedure is complicated. Because the light string is fixedly fastened inside the lighted inflatable device during the manufacturing process of the lighted inflatable device, packing the lighted inflatable device must be very careful so as not to damage the light string fastened therein. In case any light bulb of the light string is damaged during delivery, it can not be replaced or repaired and, the lighting effect of the light string will be unfavorably affected. Further, damage of any light bulb of the light string may cause the glass fragments of the damaged light bulb to pierce through the cloth of the lighted inflatable device. If the lighted inflatable device has any air leakage problem, it becomes useless.

SUMMARY OF THE INVENTION

The present invention has been accomplished to eliminate the aforesaid problems. It is therefore the main object of the present invention to provide an electric coupler for a lighted inflatable device which allows the light string which is to be fastened inside a lighted inflatable device to be packed separately during delivery. According to the present invention, an electric coupler for a lighted inflatable device is generally comprised of a base and a cap. The base is attached to the cloth of a lighted inflatable device at the inside through the process of heat sealing, and defines therein a passage way for the insertion therein of a light string from the outside. The cap which is fastened in the base through a screw joint with a rubber gasket squeezed in therebetween to air-tightly block up the passage way has terminals for connecting an external power supply to the light string which is inserted inside the lighted inflatable device through the passage way of the base. In an alternate form of the present invention, an insert is releasably inserted in the base and locked in place to block up the passage way by a ring-shaped lock nut, which insert has terminals for connecting an external power supply to the light string which is inserted inside the lighted inflatable device through the passage way of the base.

DETAILED DESCRIPTION OF THE PREFERRED EMBODIMENTS

Figure 2:
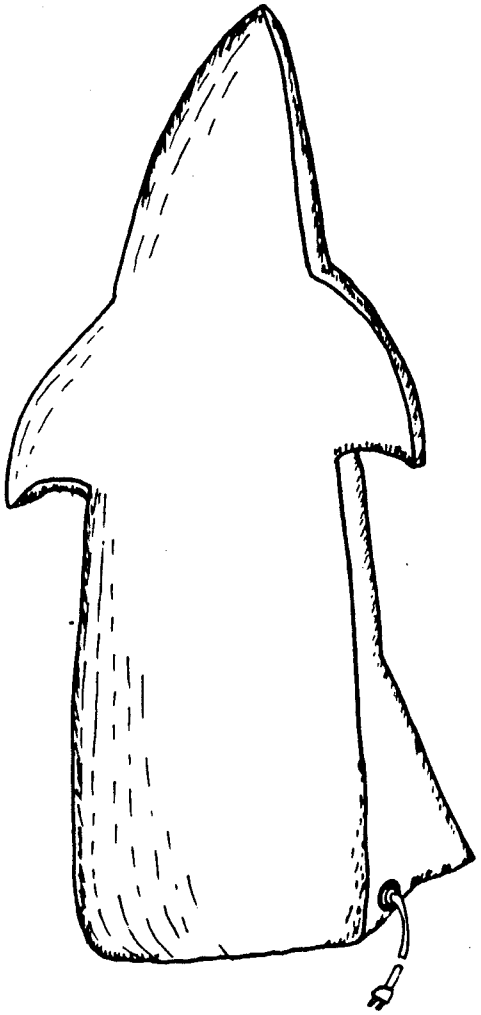
FIG. 2 illustrates another lighted inflatable device constructed according to the present invention.
Figure 1:
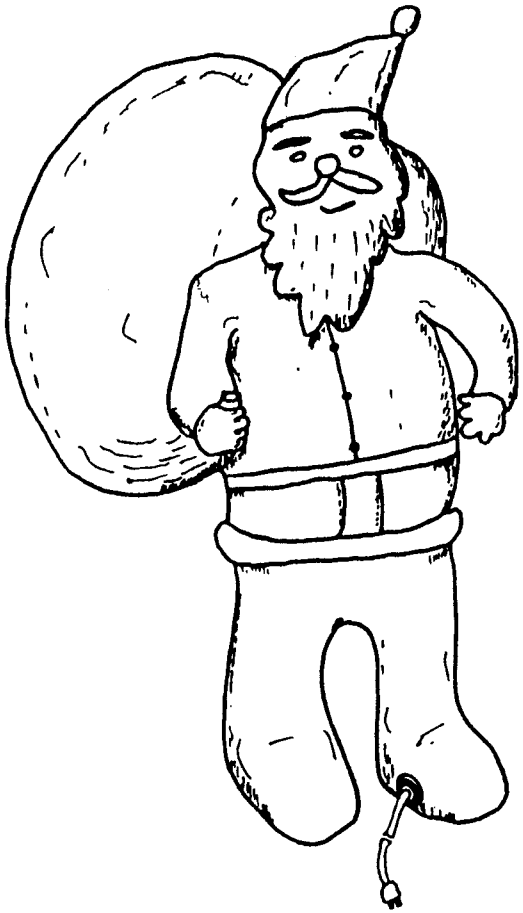
FIG. 1 illustrates a lighted inflatable device constructed according to the present invention.

Referring to FIGS. 1 and 2, a lighted inflatable device in which the present invention is installed may be made in any of a variety of shapes for any of a variety of purposes, which when connected to an electric power supply produces lighting effect.

Figure 3:
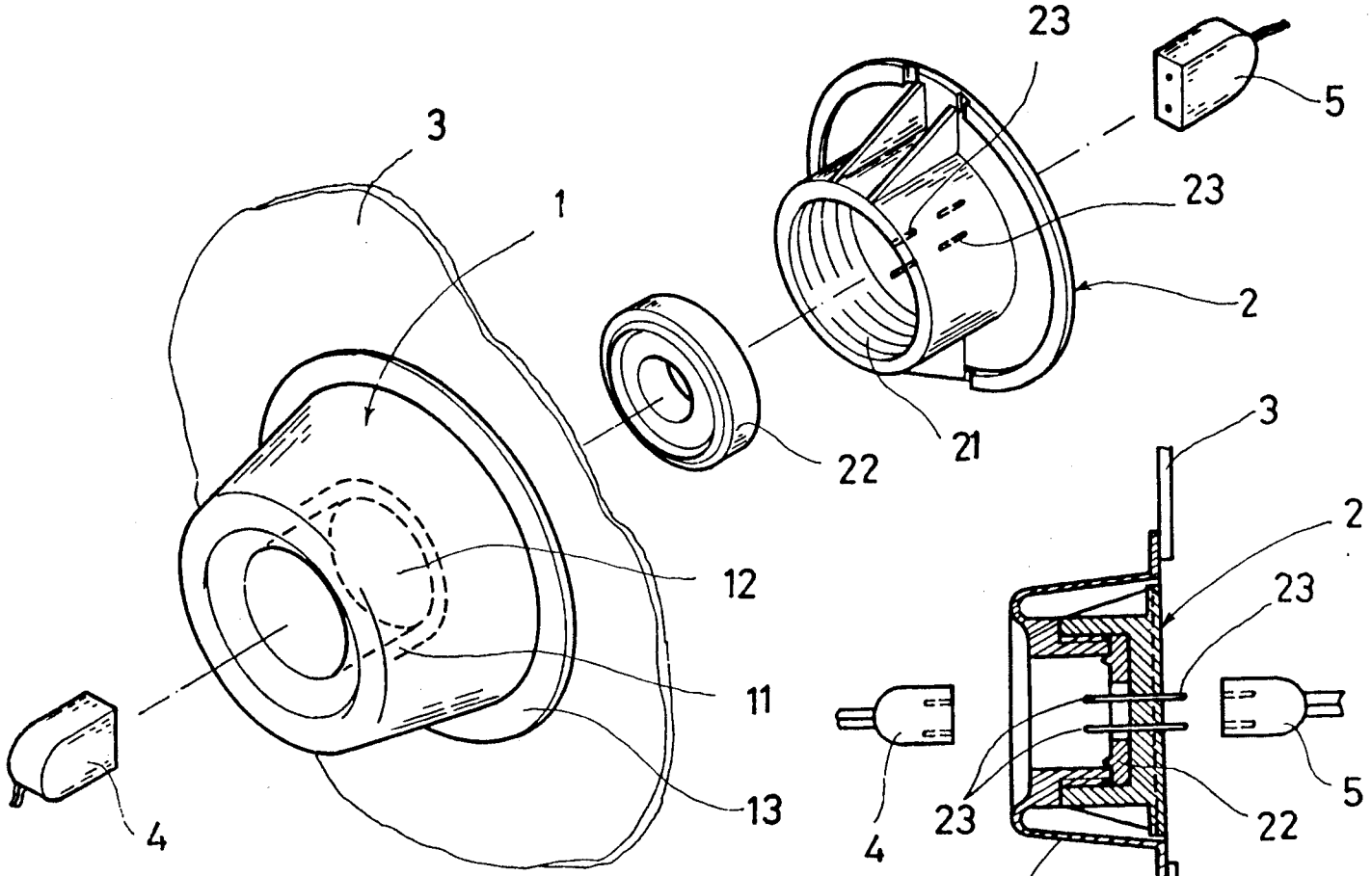
FIG. 3 is an exploded perspective view of an electric coupler embodying the present invention.
Figure 4:
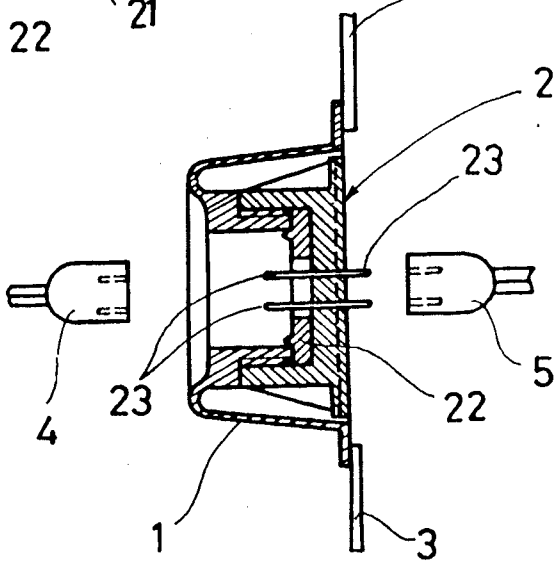
FIG. 4 is a sectional view of the electric coupler of FIG. 3.

Referring to FIGS. 3 and 4, therein illustrated is an electric coupler embodying the present invention which is generally comprised of a base 1 and a sealing cap 2 connected through screw joint. The base 1 has an outer thread portion 11 at the inside defining therein a passage way 12 and a flange 13 around the top edge thereof. The sealing cap 2 has an inner thread portion 21 corresponding to the outer thread portion 11 of the base 1 for connection, and two conductive terminals 23 longitudinally disposed at the middle. Before fastening the sealing cap 2 to the base 1, a rubber gasket 22 is sleeved on the outer thread portion 11 to seal the gap between the base 1 and the sealing cap 2. During manufacturing process, the base 1 is attached to a lighted inflatable device 3 at the inside by attaching the flange 13 to the cloth of said lighted inflatable device 3 through the process of high frequency heat sealing with the passage way 12 opened to the outside (a hole is made on the cloth of the lighted inflatable device 3 at location corresponding to the passage way 12 on the base 1). By means of the aforesaid arrangement, light string can be separately packed during delivery. The lighted inflatable device 3 has hook or hanger means or suitable fastening means for holding a light string therein (not shown). The passage way 12 on the base 1 is made in size suitable for inserting the light string to be fastened inside the lighted inflatable device 3. Once the light string is fastened inside the lighted inflatable device 3, the connector 4 of the light string is inserted through the rubber gasket 22 and connected to the two conductive terminals 23 of the cap 2 and then, the cap is tightly fastened inside the base 1 to seal up the passage way 12. By connecting the opposite ends of the conductive terminals 23 to an external power supply through a connector 5, the light string is turned on to produce light.

Figure 5:
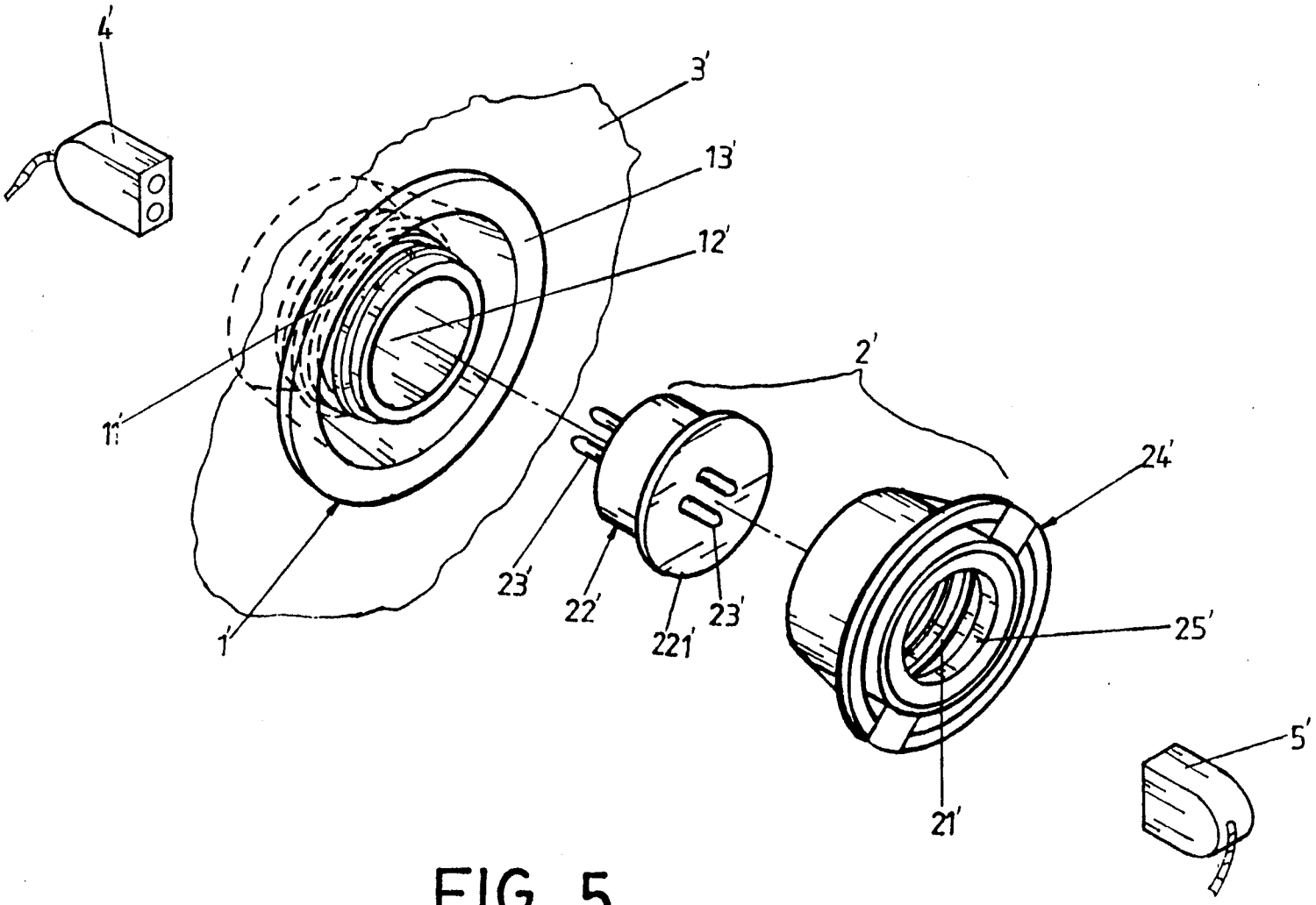
FIG. 5 is an exploded perspective view of an alternate form of electric coupler of the present invention.
Figure 6:
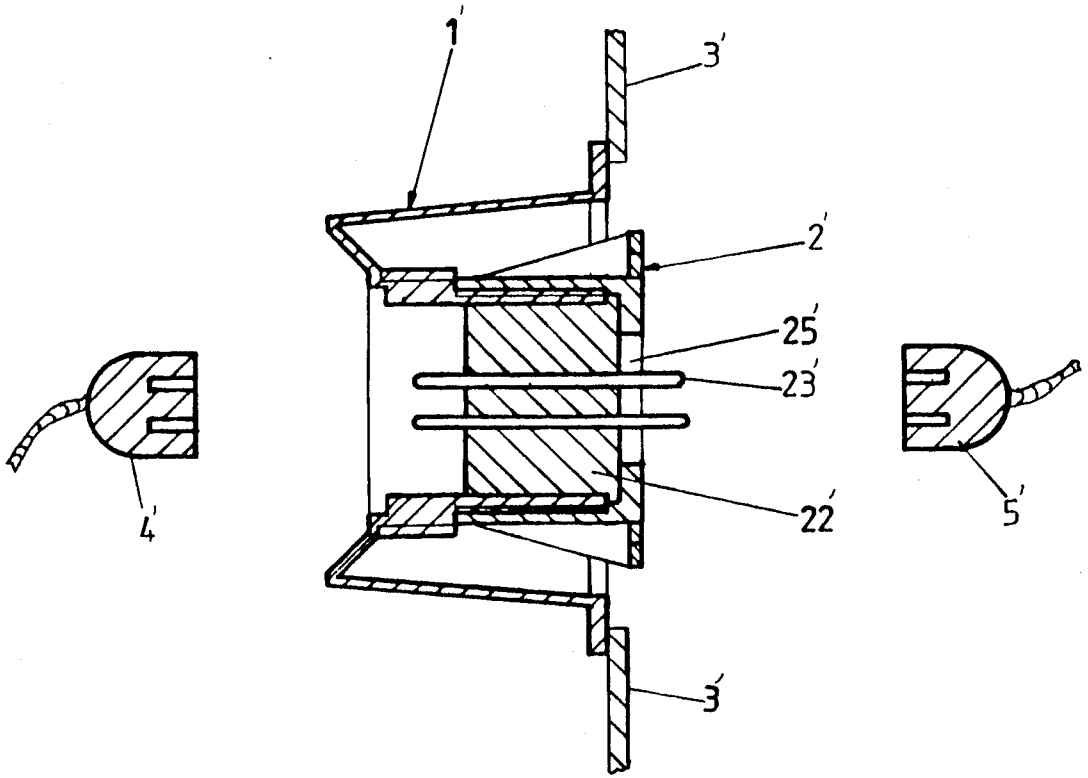
FIG. 6 is a sectional view of the electric coupler of FIG. 5.
Figure 7:
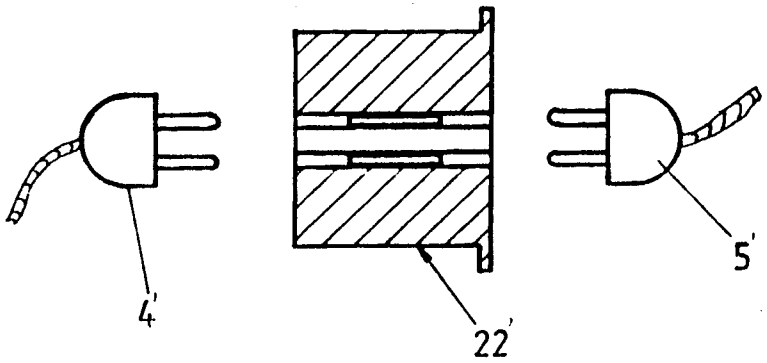
FIG. 7 illustrates an alternate form of the insert.

Referring to FIGS. 5 and 6, therein illustrated is an alternate form of the present invention which is generally comprised of a base 1' and a cap 2'. In this embodiment, the structure of the base 1' remains unchanged. The cap 2' is comprised of an insert 22' and a lock nut 24'. The insert 22' has a top flange 221' at the top and two conductive terminals 23' longitudinally disposed at the middle with two opposite ends respectively protruding beyond the top and bottom edges of the insert. By inserting the insert 22' in the passage way 12' on the base 1' with the flange 221' stopped at the top, the passage way 12' is completely blocked up. The lock nut 24' has an inner thread portion 21' on the boring bore 25' thereof. As soon as the insert 22' is inserted in the passage way 12', the inner thread portion 21' of the lock nut 24' is screwed up with the outer thread portion 11', and therefore, the insert 22' is tightly secured in place by the lock nut 24'. The installation process of this alternate form of electric coupler is similar to the first embodiment of the present invention. In this embodiment, the two conductive terminals 23' each has two opposite ends respectively protruding beyond the top or bottom edge of the insert 22'. In an alternate form of insert, the two opposite ends of each conductive terminal may be concealed inside the insert 22', as shown in FIG. 7, for connecting a plug connector 4' from a light string and a plug connector 5' from a power supply.

While the present invention has been described in conjunction with the aforesaid preferred embodiments, it is to be understood that various modifications and alternations can be made without departing from the basic teachings of the present invention. Recognizing that various modifications and alternations are apparent, the scope herein shall be deemed as defined in the claims set forth hereinafter.

What is claimed is:

1. For a lighted inflatable device, an electric coupler comprising a base heat sealed to the inside of a lighted inflatable device, said base having a passage way defined therein for inserting a light string inside said lighted inflatable device, and a sealing device fastened in said base, wherein said sealing device being comprised of an insert releasably inserted in said base to air-tightly block up said passage way, said insert having terminals for connecting an external power supply to the light string inserted inside said lighted inflatable device by connectors, and a lock nut fastened in said base through a screw joint to tightly secure said insert in place.

2. An electrical coupler assembly for use with a lighted inflatable device comprising:

a base adapted to be located within an opening formed in an inflatable device and heat sealed therein, said base including a central passage way for inserting a light string inside the inflatable device; and sealing means adapted to be secured to said base to seal said central passage way, said sealing means including an insert which extends into said central passage way and is threadably attached to said base in an air-tight manner, said sealing means carrying electrical terminals for electrically interconnecting an external power supply and a light string inserted inside the inflatable device.

* * * * *